United States Patent [19]

Stables et al.

[11] 4,298,153

[45] Nov. 3, 1981

[54] INTERFLOOR TUBE ASPIRATOR INLET MUFFLER

[75] Inventors: Wilbur L. Stables, Matoaca; David Pendlebury, Chester, both of Va.; William R. Weiss, Walnut Creek, Calif.

[73] Assignee: Allied Corporation, New York, N.Y.

[21] Appl. No.: 147,439

[22] Filed: May 7, 1980

[51] Int. Cl.[3] ..... B65H 17/32; D02G 1/16

[52] U.S. Cl. ..... 226/97; 28/271; 181/264

[58] Field of Search ..... 226/7, 97; 28/271; 181/264

[56] References Cited

U.S. PATENT DOCUMENTS

| | | | |
|---|---|---|---|
| 3,545,565 | 12/1970 | McCaffrey | 181/35 |
| 4,024,698 | 5/1977 | Weiss | 57/34.5 |
| 4,030,651 | 6/1977 | Weiss | 226/97 |
| 4,040,782 | 8/1977 | Weiss | 28/271 |
| 4,043,008 | 8/1977 | Weiss | 28/271 |
| 4,110,876 | 9/1978 | Weiss | 28/271 |
| 4,113,051 | 9/1978 | Moller | 181/231 |
| 4,116,303 | 9/1978 | Trudell | 181/252 |
| 4,263,982 | 4/1981 | Feuling | 181/256 |

*Primary Examiner*—Edward J. McCarthy
*Attorney, Agent, or Firm*—Virginia S. Andrews

[57] ABSTRACT

A muffler (10) for use in conjunction with an interfloor tube and aspirator (20) during the production of multifilament, synthetic yarn is provided. Audible noise which is emitted at the inlet end of the interfloor tube is reduced by up to 10 Δdb(A) through the use of a perforated tube (11), restrictor plate (13) and sound absorbing material (16).

4 Claims, 3 Drawing Figures

INTERFLOOR TUBE ASPIRATOR INLET MUFFLER

BACKGROUND OF THE INVENTION

1. Field of the Invention

This invention relates to an apparatus for use during the production of multifilament, synthetic yarn. In particular, it relates to a muffler, for use in conjunction with an interfloor tube and aspirator, which reduces by up to 10ΔdB(A) the noise emitted at the inlet end of the interfloor tube when the aspirator is operational.

Throughout the present specification and claims, the term "dB(A)" (decibels-A-weighted) connotes a unit of measurement of sound level corrected to the A-weighted scale, as defined in ANSI S1.4–1971, using a reference level of 20 micropascals ($2\times10^{-5}$ Newtons per square meter). The term "ΔdB(A)" refers to the difference between two noise levels where each level is expressed in units of dB(A). The term "yarn" is employed in a general sense to indicate strand material, either textile or otherwise, and including a continuous, often plied, strand composed of fibers, filaments, glass, metal, asbestos, paper, or plastic, or a noncontinuous strand such as staple, and the like. An "end" is one or a contiguous group of such strands of yarn. The "extrusion rate" is the number of pounds of polymer extruded per hour per position.

2. DESCRIPTION OF THE PRIOR ART

In a typical melt spinning process, one or more filaments is extruded from one or more spinnerettes and passed into a quenching chamber for cooling. Further process equipment, for instance drawing or winding apparatus, is usually spaced a considerable distance vertically downwardly therefrom. In fact, it is normal practice to have the process equipment spaced over three tiers with the extrusion apparatus occupying the uppermost tier or floor, with the quenching apparatus occupying the intermediate floor, and any further process equipment residing on the bottom floor. In order to convey the yarn from the quenching area to the bottom floor, it is conventional to provide an interfloor tube. To initiate string-up, an operator catches the advancing quenched filaments and throws them towards the entrance to the interfloor tube through which they fall to be picked up by either a string-up aspirator or a panel aspirator. An aspirator is usually employed in conjunction with the interfloor tube to accelerate the speed of the yarn to extrusion speed as the yarn does not fall fast enough due to drag. The smaller the inner diameter of the interfloor tube the greater the necessity for an aspirator due to the increased drag on the yarn. Therefore, to initiate string-up, an aspirator for use in conjunction with the interfloor tube should be turned on and remain on until the yarn end or ends thrown through the tube have been picked up by either a panel aspirator or a string-up aspirator, at which time the interfloor tube aspirator is turned off.

The aspirator is preferably located at the inlet portion of the interfloor tube where high velocity air is introduced and then directed downwardly to create the desired suction effect. Noise is produced at and downstream of the point at which this high velocity air is introduced. The sound waves thus generated are then propagated through both the inlet and exit ends of the interfloor tube. U.S. Pat. No. 4,030,651 to Weiss et al. discloses a muffler for the exit end of an interfloor tube and aspirating means. The noise emitted, as measured at a distance of about one foot (30.5 cms.) from the center line of the interfloor tube and at about 2.5 feet (76.2 cms.) above the intermediate floor and at an air supply line pressure of 100 psig, has been found to exceed 100 dB(A) in some instances without use of this invention.

The high level noise emitted from the interfloor tube inlet occurs only during string-up, and as a component in a process which has several other sources of noise, it is desirable to bring its noise level down to tolerable limits. Applicants therefore provide a muffler which reduces the noise emitted at the inlet end of the interfloor tube by up to 10ΔdB(A) to thereby bring the noise within acceptable levels.

SUMMARY OF THE INVENTION

The present invention provides a muffler for use in conjunction with an interfloor tube and aspirator during the production of multifilament synthetic yarn wherein the interfloor tube comprises a tube and a yarn inlet passage which extends into the tube. The muffler comprises as its essential elements a perforated second tube, a restrictor plate, and sound absorbing material.

The perforated second tube has an outside diameter which is smaller than the inside diameter of the yarn inlet passage. Further, the perforated second tube has a plurality of perforations which create an open area for the perforated second tube of from 35 to 95 percent, more preferably 50 to 90 percent, the length of the perforated second tube being essentially coextensive with the yarn inlet passage.

The restrictor plate is mounted so as to cover the entrance to the yarn inlet passage. The perforated second tube is mounted at one end to the restrictor plate so as to be within the yarn inlet passage and to define an annular chamber therebetween. The restrictor plate has an opening communicating with the opening of the perforated second tube. The smallest dimension of the opening of the restrictor plate is at least about 0.1875 inch (0.4763 cm.) at yarn extrusion rates of up to 50, more preferably 5 to 50, pounds per hour per position and at least about 0.5000 inch (1.27 cms.) at yarn extrusion rates of about 51 to 160, more preferably 90 to 125, pounds per hour per position. It is preferred that the smallest dimension of the opening of the restrictor plate be less than about 0.625 inch (1.59 cms.). The sound absorbing material is disposed throughout the annular chamber.

When the aspirator is operational, the noise level at the inlet of the interfloor tube is reduced by up to 10ΔdBA by the muffler. The invention will be more clearly understood and additional objects and advantages will become apparent upon reference to the discussion below and to the drawings which are given for illustrative purposes.

DETAILED DESCRIPTION OF THE DRAWINGS

Figure 1:
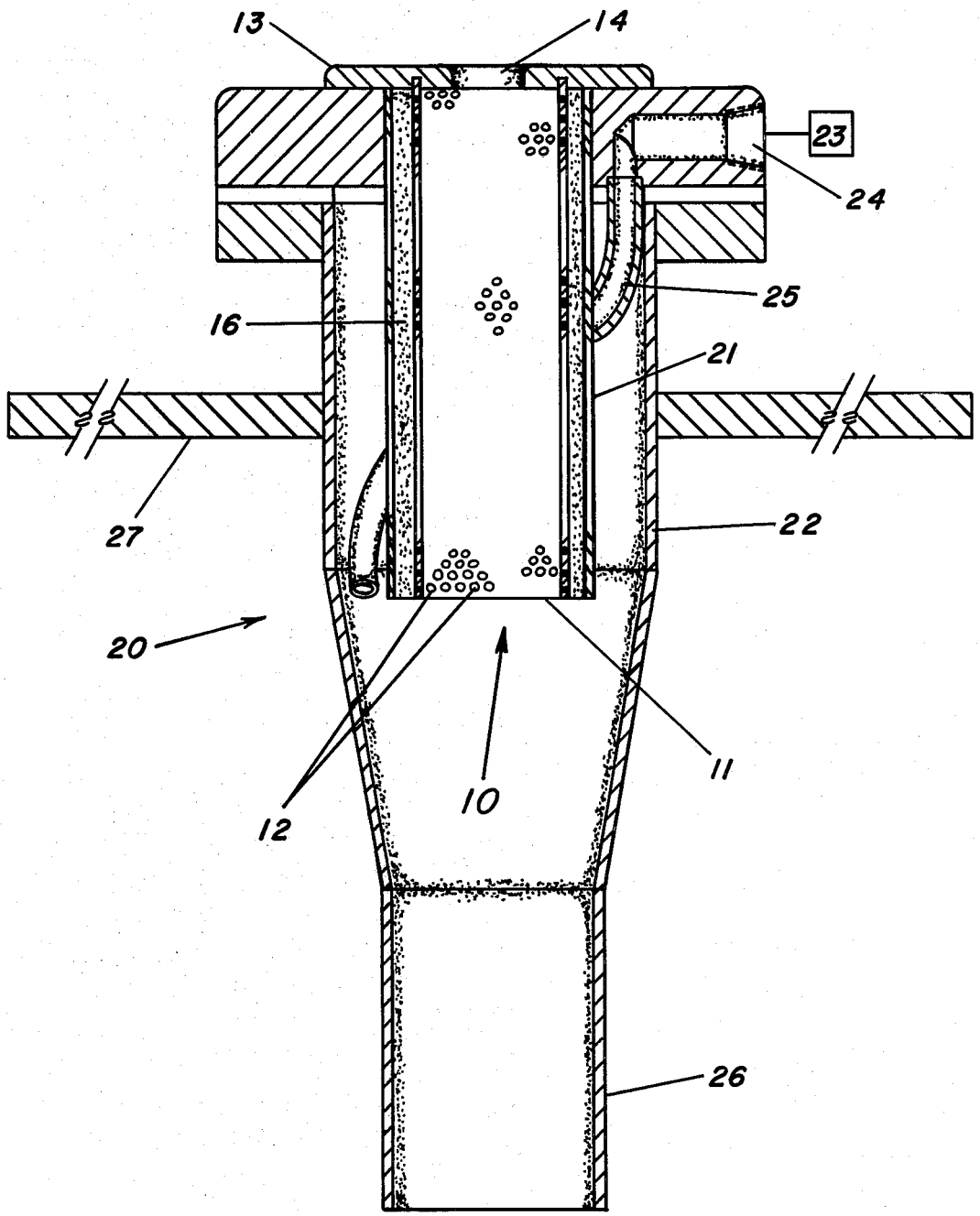
FIG. 1 is a sectional view of the interfloor tube and aspirator with the muffler of the present invention.

In the accompanying drawings, like numbers refer to like apparatus. It is to be understood that only enough of the interfloor tube and aspirator have been shown in the drawings to enable those skilled in the art to understand and appreciate the underlying concept of the inlet muffler comprising the present invention. For more detail on the interfloor tube and aspirator and their use in a typical melt spinning process, reference may be had to U.S. Pat. No. 4,030,651 to Weiss et al., hereby incorporated by reference.

Briefly and with reference to FIG. 1, the interfloor tube and aspirator 20 have as their major elements a cylindrical yarn inlet passage 21, a cylindrical tube 22, a source of air under pressure 23, a duct 25, and a yarn outlet tube 26. Cylindrical tube 22 and yarn passage 21 are concentric with respect to one another, with cylindrical tube 22 having a substantially larger diameter and surrounding yarn passage 21. Cylindrical tube 22 starts a gradual inward taper at that point corresponding to the exit end of yarn passage 21. Cylindrical tube 22 tapers to a neck, having a diameter approximately equal to that of yarn passage 21, where it is connected to yarn outlet tube 26. Means for mounting yarn passage 21 and cylindrical tube 22 in fixed relation to one another is provided. Duct 25 is connected to inlet pipe 24 which is adapted for connection to a source of air under pressure 23. Duct 25 describes a half helical turn about the exterior of yarn passage 21 in the annular space left between yarn passage 21 and cylindrical tube 22. Duct 25 terminates near the exit end of yarn passage 21, and delivers air under pressure to create suction by the Bernoulli effect at the tapered portion of tube 22, when the source of air under pressure 23 is triggered by a suitable means.

Figure 3:
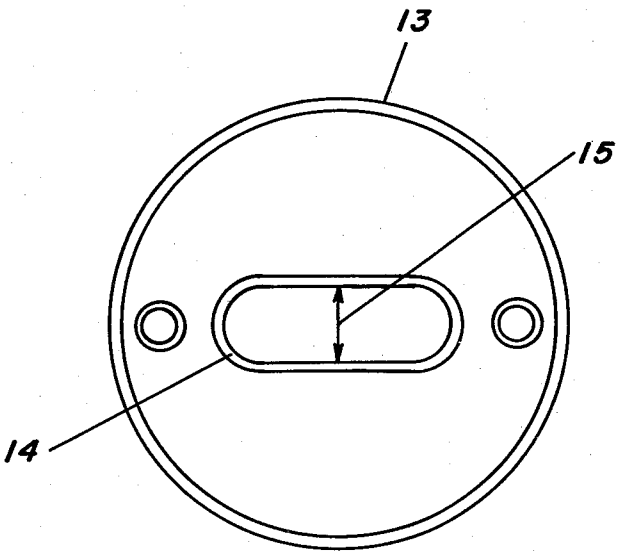
FIG. 3 is a plan view of the restrictor plate of FIGS. 1 and 2.
Figure 2:
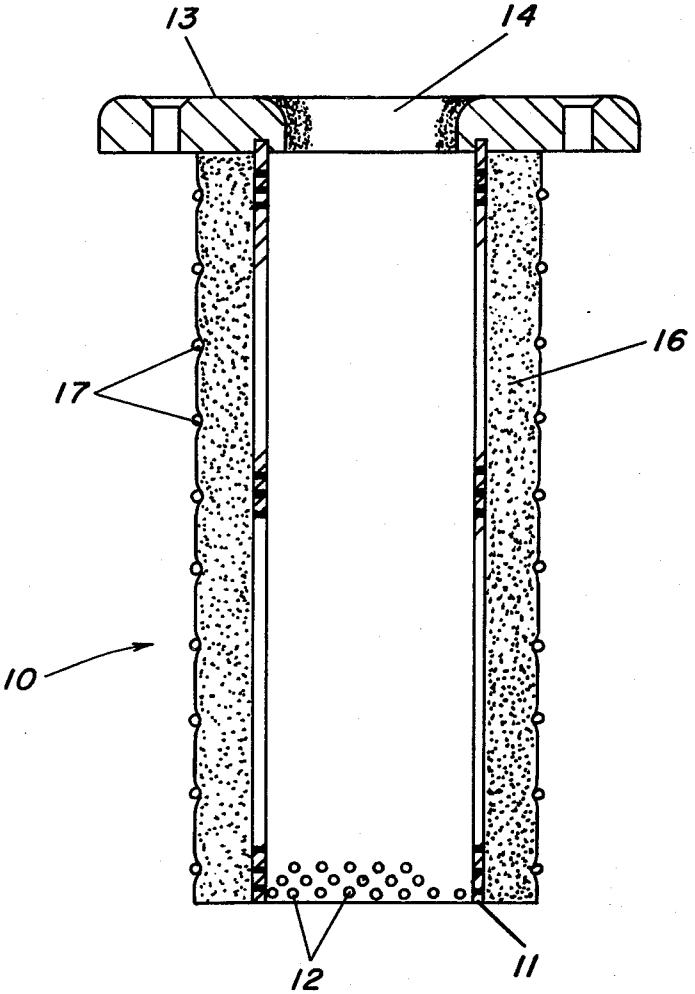
FIG. 2 is a sectional view of the muffler (as an insert) of the present invention.

With reference to FIGS. 1, 2 and 3, muffler 10 has as its major elements perforated second tube 11, restrictor plate 13 and sound absorbing material 16.

Perforated second tube 11 has an outside diameter which is smaller than the inside diameter or yarn inlet passage 21. Further, perforated second tube 11 has a plurality of perforations 12 which create an open area for perforated second tube 11 of from about 35 to 95 percent, more preferably from about 50 to 90 percent. The length of perforated second tube 11 is essentially coextensive with that of yarn inlet passage 21.

With reference to FIGS. 1, 2 and 3, restrictor plate 13 is mounted, for instance by bolts, so as to cover the entrance to yarn inlet passage 21. Perforated second tube 11 is mounted at one end to restrictor plate 13, for example by tack welding, so as to be within yarn inlet passage 21 and define an annular chamber therebetween. Restrictor plate 13 has an opening 14 communicating with the opening of perforated second tube 11. The smallest dimension 15 of opening 14 of restrictor plate 13, the slot width for example in FIG. 3, is at least about 0.1875 inch (0.4763 cm.) at yarn extrusion rates of up to 50 pounds per hour per position, and at least about 0.5000 inch (1.27 cms.) at yarn extrusion rates of about 51 to 160 pounds per hour per position. The opening 14 may be circular when the minimum, smallest dimension 15 is utilized and only a single end of yarn is being processed. When multiple ends of yarn are being processed, it is preferred that opening 14 be shaped like a slot as depicted in FIG. 3. At the given extrusion rates, a smaller smallest dimension 15 for opening 14 creates processing problems; even with very skilled operators, opening 14 will choke up about 75 to 80 percent of the time during string-up. Acoustically, it is preferred that opening 14 be as small as possible to create a greater velocity of air being sucked into yarn inlet passage 21. This air will impede some of the sound waves travelling up passage 21 toward opening 14. Also, the smaller that opening 14 is kept, the less acoustic energy will be permitted to escape.

Sound absorbing material 16 is disposed throughout the annular chamber between perforated second tube 11 and yarn inlet passage 21. Sound absorbing material 16 may be affixed to perforated second tube 11 as depicted in FIG. 2 to form a muffler insert by, for example, spirally wrapping a fine diameter cord or thread 17 about a sheet of sound absorbing material 16.

Sound absorbing material 16 is an acoustic liner for yarn inlet passage 21 and dissipates sound by transforming the acoustical mechanical energy of the sound waves into thermal energy. It is preferred that sound absorbing material 16 be an open-celled foam, for example fine pore polyester urethane foam. An open area of under 35 percent for perforated second tube 11, which serves a retentive function, decreases the absorption of sound waves by sound absorbing material 16, and an open area in excess of 95 percent decreases the retentive function of perforated second tube 11 to a critical degree.

EXAMPLE 1

The apparatus of the present invention was set up in a sound laboratory as shown in the drawings. Opening 14 in restrictor plate 13 had a slot width of about 0.5000 inch (1.27 cms.). The diameters of perforations 12 are approximately 0.075 inch (0.191 cm.), with perforations 12 being staggered on 0.100 inch (0.254 cm.) centers, to create a total open area of approximately 50 percent for perforated second tube 11. A fine pore polyester urethane foam is utilized as the sound absorbing material 16, more specifically Scottfelt Grade 3-900 manufactured by the Scott Paper Company, Foam Division, 0.250 inch (0.635 cm.) thick. The foam was wrapped around perforated second tube 11 and secured with a fine diameter cord or thread 17 spirally wrapped at approximately 0.500 inch (1.27 cms.) centers. The noise level was measured at a distance of about 1 foot (30.5 cms.) from the center line of the interfloor tube and at elevations of about 2.5 feet (76.2 cms.) and 3.5 feet (106.7 cms.) above floor 27 at air supply line pressures of 60 and 100 psig. The readings taken are listed in Table I.

For the sake of comparison, readings were also taken wherein perforated second tube 11 and sound absorbing material 16 were omitted, and wherein the slot width was 0.625 inch (1.59 cms.). The results are listed in Table I.

TABLE I

| Perforated Second Tube and Sound Absorbing Material | Air Supply Line Pressure (psig) | Elevation (ft./cms.) | Slot Width (in./cms.) | Noise Level dBA |
|---|---|---|---|---|
| Yes | 60 | 2.5/76.2 | 0.500/1.27 | 88.5 |
| No | 60 | 2.5/76.2 | 0.625/1.59 | 96.4 |
| Yes | 60 | 3.5/106.7 | 0.500/1.27 | 85.5 |
| No | 60 | 3.5/106.7 | 0.625/1.59 | 93.7 |
| Yes | 100 | 2.5/76.2 | 0.500/1.27 | 93 |
| No | 100 | 2.5/76.2 | 0.625/1.59 | 101 |
| Yes | 100 | 3.5/106.7 | 0.500/1.27 | 89.5 |

TABLE I-continued

| Perforated Second Tube and Sound Absorbing Material | Air Supply Line Pressure (psig) | Elevation (ft./cms.) | Slot Width (in./cms.) | Noise Level dBA |
|---|---|---|---|---|
| No | 100 | 3.5/106.7 | 0.625/1.59 | 98.5 |

EXAMPLE 2

Example 1 was repeated except that the slot width 15 was 0.1875 inch (0.4763 cm.) Readings were taken at an air supply line pressure estimated at 90 to 100 psig. For the sake of comparison, readings were also taken wherein perforated second tube 11 and sound absorbing material 16 were omitted, and wherein the slot width was 0.625 inch (1.59 cms.). The results are listed in Table II.

TABLE II

| Perforated Second Tube and Sound Absorbing Material | Elevation (ft./cms.) | Noise Level dB(A) |
|---|---|---|
| No | 2.5/76.2 | 99.5 |
| Yes | 2.5/76.2 | 89.5 |
| No | 3.5/106.7 | 96 |
| Yes | 3.5/106.7 | 86.5 |

Example 1 above illustrates the preferred apparatus of the present invention and is not to be considered limiting of the invention in any means. Various modifications and other advantages will be apparent to one skilled in the art, and it is intended that this invention be limited only as set forth in the following claims.

What is claimed is:

1. A muffler for use in conjunction with an interfloor tube and aspirator during the production of multifilament synthetic yarn wherein the interfloor tube comprises a tube and a yarn inlet passage which extends into the tube, the muffler comprising:

a. a perforated second tube having an outside diameter which is smaller than the inside diameter of the yarn inlet passage, the perforated second tube having a plurality of perforations which create an open area for the perforated second tube of from 35 to 95 percent, the length of the perforated second tube being essentially coextensive with the yarn inlet passage;

b. a restrictor plate, mounted so as to cover the entrance to the yarn inlet passage, the perforated second tube being mounted at one end to the restrictor plate so as to be within the yarn inlet passage and define an annular chamber therebetween, the restrictor plate having an opening communicating with the opening of the perforated second tube, the smallest dimension of the opening of the restrictor plate being at least about 0.1875 inch (0.4763 cm.) at yarn extrusion rates of up to 50 pounds per hour per position and at least about 0.5000 inch (1.27 cms.) at yarn extrusion rates of about 51 to 160 pounds per hour per position; and c. sound absorbing material, disposed throughout the annular chamber; whereby the noise level at the inlet of the interfloor tube is reduced by up to 10ΔdB(A) by the muffler when the aspirator is operational.

2. The muffler of claim 1 wherein the smallest dimension of the opening of the restrictor plate is at least about 0.5000 inch (1.27 cms.) at yarn extrusion rates of about 51 to 125 pounds per hour per position.

3. The muffler of claim 1 wherein the smallest dimension of the opening of the restrictor plate is about 0.1875 to 0.5000 inch (0.4763 to 1.27 cms.) at yarn extrusion rates of up to 50 pounds per hour per position.

4. The muffler of claim 1 wherein the smallest dimension of the opening of the restrictor plate is less than about 0.625 inch (1.59 cms.)

* * * * *